United States Patent [19]

Castagna

[11] 4,004,379

[45] Jan. 25, 1977

[54] SCRATCH PREVENTER

[76] Inventor: Gerald Castagna, P.O. Box 62, Cedar Point, Ill. 61316

[22] Filed: Apr. 14, 1975

[21] Appl. No.: 568,122

[52] U.S. Cl. ..... 51/274

[51] Int. Cl.[2] ..... B24B 55/00

[58] Field of Search ..... 51/274, 262; 269/9; 24/73 MS; 335/303; 7/1 Q; 15/20; 408/76

[56] References Cited

UNITED STATES PATENTS

| | | | |
|---|---|---|---|
| 514,863 | 2/1894 | Meredith | 51/265 |
| 758,372 | 4/1904 | Marsh | 51/274 |
| 3,210,068 | 10/1965 | Shelton | 269/8 |
| 3,346,897 | 10/1967 | Nelson | 51/274 |
| 3,480,894 | 11/1969 | Joyce | 335/303 |
| 3,873,954 | 3/1975 | Baermann | 335/303 |

OTHER PUBLICATIONS

IBM Technical Disclosure Bulletin by F. Daniels & S. Jenkins vol. 12 No. 6 Nov. 1969, p. 743.

*Primary Examiner*—Al Lawrence Smith
*Assistant Examiner*—Nicholas P. Godici
*Attorney, Agent, or Firm*—Mason, Kolehmainen, Rathburn & Wyss

[57] ABSTRACT

A scratch preventer for use in preventing a sanding tool from straying onto a surface of a panel adjacent a workpiece that is being sanded includes a panel or sheet of molded elastomeric material having magnetized material included therein to permit the panel to attach magnetically to a metal panel. The scratch preventer further includes a lip having a narrow transverse dimension molded onto and extending vertically from a first surface of the preventer such that the lip may be inserted into a gap between the workpiece and an adjacent surface not intended to be sanded. The preventer also includes a bumper molded on a second surface of the panel and having a transverse dimension substantially greater than the aforementioned lip. The bumper is vertically offset from the lip such that a sanding tool will collide with the bumper if the tool strays from the workpiece toward the adjacent surface.

1 Claim, 3 Drawing Figures

SCRATCH PREVENTER

BACKGROUND OF THE INVENTION

A. Field of the Invention

The device of the present invention generally relates to a new and improved scratch preventer for preventing a tool such as a sander from straying from a workpiece across a boundary defined by a gap to an adjacent surface which is not desired to be sanded.

B. Description of the Prior Art

In repairing damage to the metal body of automobiles, the damage is often times isolated to one or only a few panels on the automobile. Consequently, repair work need only be done on a particular panel and requires pounding out the dent or filling in the scratch, sanding down the general area and repainting that particular panel on the automobile.

A problem exists where the damage occurs or sanding must be done at or near the edge of a panel. During the sanding operation, the torque created by the sander makes it difficult for the operator to sand only the damaged panel while preventing the sander from straying across the gap separating adjacent panels and scratching the undamaged panel. If this straying occurs, painting of a panel not previously damaged will be necessary resulting in increased cost to the automobile owner.

Presently, a vinyl tape attached to the undamaged panel along the gap separating the undamaged panel from the damaged panel is used. During the sanding and grinding operation, if the tool strays onto the undamaged panel, the vinyl tape is often cut by the tool and the panel damaged.

SUMMARY OF THE INVENTION

An object of the present invention is to provide a new and improved device for preventing damage to surfaces adjacent to a work surface during sanding operations or the like.

Moreover, another object of the present invention is to provide a new and improved scratch preventer that is attached to metal surfaces and includes a lip that may be inserted in the gap between adjacent metal panels of an automobile, and also includes a bumper that serves to prevent a sanding tool or the like from wandering from the work surface onto the adjacent surface.

Briefly, the present invention is directed to a new and improved device, referred to herein as a scratch preventer, for use, in a specific embodiment, in repair of the metal panels of automobiles.

The scratch preventer comprises a panel or layer of elastomeric material having a granular magnetic material mixed therewith such that the scratch preventer may be magnetically attached to a metal surface. The scratch preventer further includes an integrally molded lip extending vertically from a first surface of the panel. The lip is of a narrow transverse dimension such that it may be inserted in the gap between a workpiece and an adjacent panel. The scratch preventer further includes an integral bumper molded on and extending vertically from a second surface of the panel. The bumper has a sufficient transverse dimension sufficient to provide rigidity and to permit its use as a barrier preventing a sanding tool from wandering or straying from the workpiece onto the adjacent panel.

BRIEF DESCRIPTION OF THE DRAWING

To the accomplishment of the foregoing and related ends, the invention comprises the features hereinafter fully described and particularly pointed out in the claims, the following description and the annexed drawing setting forth in detail a certain illustrative embodiment of the invention; this being indicative, however, of but one of the various ways in which the principle of the invention may be employed.

In said annexed drawing:

FIG. 3 is a perspective view illustrating the scratch preventer inserted between adjacent panels of an automobile or the like.

DESCRIPTION OF THE PREFERRED EMBODIMENT

Figure 1:
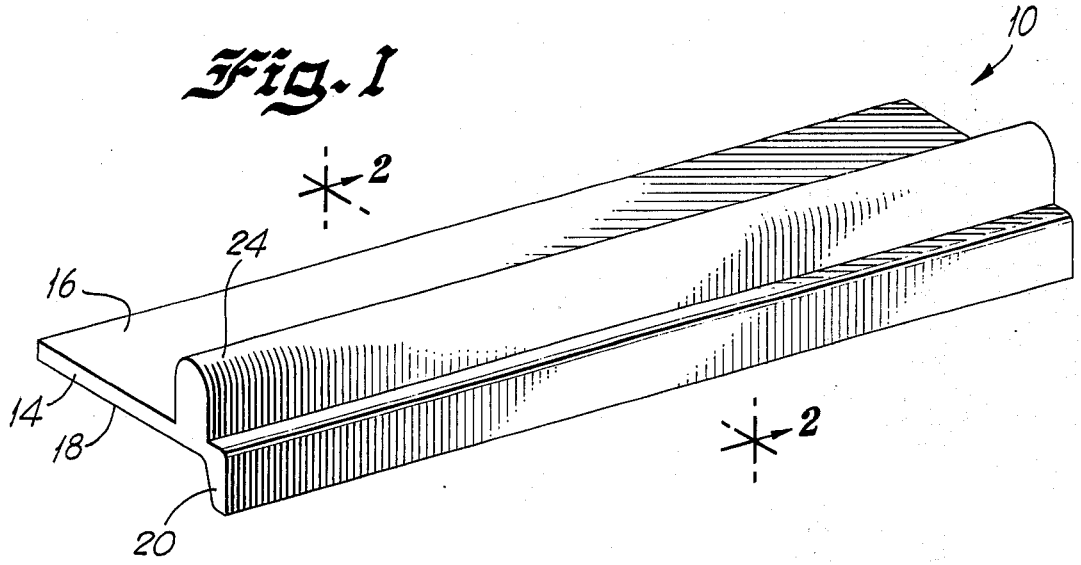
FIG. 1 is a perspective view of a preferred embodiment of a scratch preventer constructed in accordance with the principles of the present invention.
Figure 2:
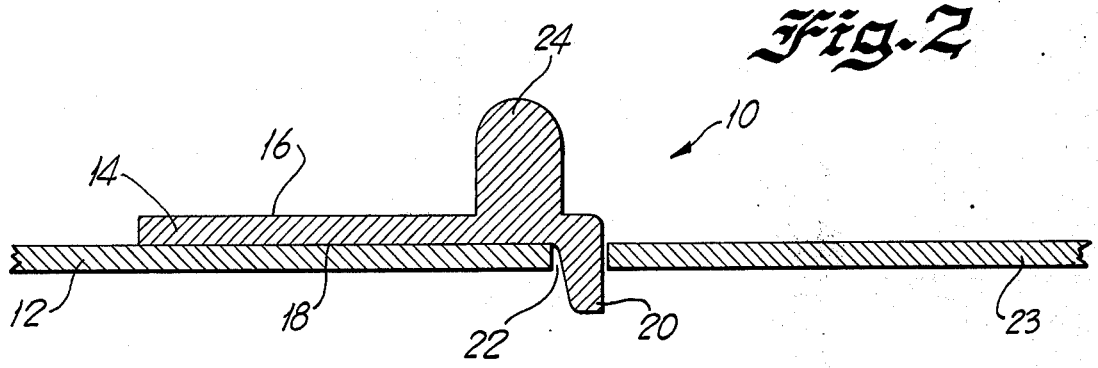
FIG. 2 is a cross-sectional view of the scratch preventer taken along line 2—2 of FIG. 1 and illustrated with two adjacent workpieces.
Figure 3:
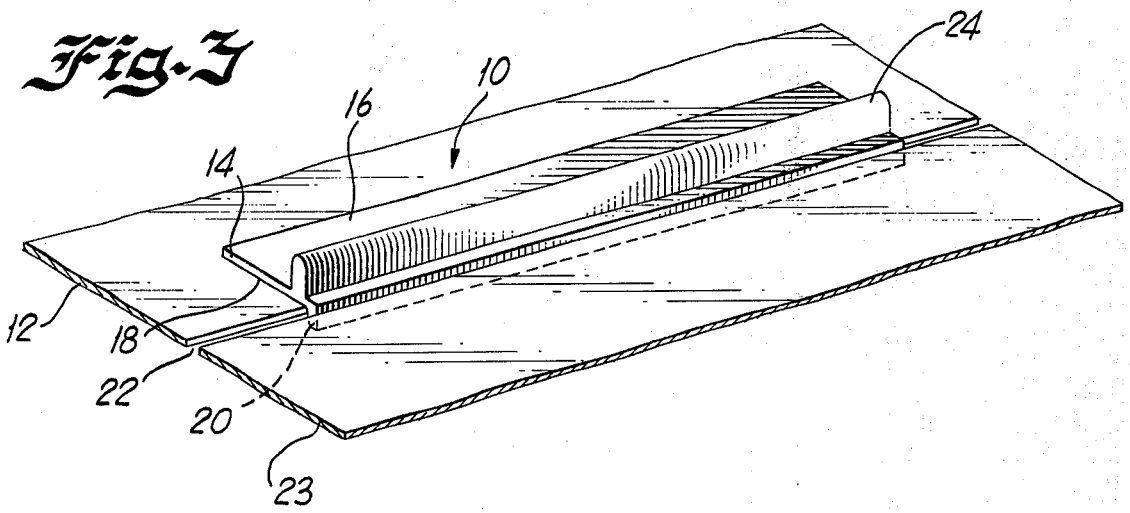

With reference to FIGS. 1–3 of the drawing, there is illustrated a new and improved scratch preventer 10 constructed in accordance with the principles of the present invention.

The scratch preventer 10 is fabricated from magnetized rubber material, that may be vinyl coated, to enable it to be magnetically attached to a metal surface such as, in a specific embodiment, panel 12 of an automobile. The scratch preventer 10 is molded in the general configuration of a sheet or panel 14 having an upper surface 16 and a lower, panel abutting surface 18.

In accordance with an important feature of the present invention, an integral lip 20 extends vertically from surface 18 and is molded along one edge of the scratch preventer. The lip 20 is of a transverse thickness such that the lip 20 may be inserted in a gap 22 between adjacent panels 12 and 23 of an automobile, for example, the gap between the hood and one of the front fenders of an automobile. The lip 20 is of the same material as the sheet or panel 14 and is sufficiently rigid such that it may not be easily, laterally bent or distorted.

In accordance with a further important feature of the present invention, the scratch preventer 10 includes a longitudinal bumper 24 molded on the upper surface 16 of the scratch preventer 10. The bumper 24 is vertically offset from the lip 20 and is of a substantially greater transverse dimension than the lip 20 in order to increase its rigidity. In this manner, if the bumper 24 is contacted by a sanding tool or the like, it will be of sufficient strength to prevent further travel of the tool in a direction transverse to the length of the scratch preventer 10.

In use, the lip 20 of scratch preventer 10 (FIGS. 2 and 3), in a specific embodiment, is positioned in a gap 22 between, for example, the hood 23 and the front fender 12 of an automobile. If the hood 23 of an automobile has a dent that is to be repaired, the normal procedure involves hammering out the dent and sanding the surrounding area. During normal operation of the sanding tool, the torque developed will cause the tool to wander or stray from the particular area of the dent in the hood 23. Accordingly, if the tool is being used along the gap 22 separating the hood 23 from the fender 12, the tool, under the influence of the torque, may begin to stray from the hood 23 in the direction of the fender 12. If the travel of the tool is not prevented, the tool could scratch the fender 23 resulting in costly damage.

If the lip 20 of the scratch preventer 10 is placed in gap 22, as the sanding tool moves towards the gap 22 and begins to wander onto the surface 12, the tool will come into contact with bumper 24 thereby preventing further travel of the tool in that direction. The sander will only act upon the upper surface 16 in front of the bumper 24. The rubber material comprising the scratch preventer 10 is of a consistency such that it will not easily be cut by the sander and this action will not result in scratching of the surface 12.

The lip 20 serves in use to aid in properly locating the scratch preventer 10 with respect to a panel to be repaired. Moreover, the bumper 24 and lip 20 act in concert with one another to prevent the scratch preventer 10 from being dislodged when contacted by a sander, grinder or other tool. More specifically, when the bumper 24 encounters a lateral force, the lip "grabs", i.e. is wedged or locked, in the gap 22.

The scratch preventer 10 may be of any length or may be cut to the length desired. The length will depend on the specific area that is to be prepared and sanded. Sufficient flexibility is provided to permit mounting the scratch preventer 10 in a slightly curved gap of the configuration commonly encountered in automobile construction.

Obviously, many modifications and variations of the present invention are possible in light of the above teachings. Thus, it is be understood that, within the scope of the appended claims, the invention may be practiced otherwise than as specifically described above.

I claim:

1. A scratch preventer for protection of a first automobile body panel during repair of an adjacent second body panel separated from the first panel by an elongated, narrow gap, said scratch preventer comprising: a unitary, one-piece body of substantially homogeneous, flexible, resilient, elastomeric and magnetic material; said body being magnetized for retention against the first automobile body panel solely by magnetic attraction; said body being elongated and generally panel-shaped and having a thickness small in comparison to its length and width permitting said body to be flexed; said body having a length substantially greater than its width; a lip formed integrally with said body and extending along the length of said body at one edge of said body; said lip having a thickness smaller than the gap between the first and second panels and having a width small in relation to the width of said body; and a bumper formed integrally with said body on the opposite side of said body from said lip, said bumper and lip being generally parallel with one another, and said bumper being thicker than said lip.

* * * * *